US012467318B2

(12) United States Patent
Malki et al.

(10) Patent No.: US 12,467,318 B2
(45) Date of Patent: Nov. 11, 2025

(54) SIDE-TRACKING A WELLBORE

(71) Applicant: Saudi Arabian Oil Company, Dhahran (SA)

(72) Inventors: Bandar S. Malki, Dammam (SA); Miguel A. Avila Romero, Dhahran (SA); Mujahid Otman Alhulailah, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/535,712

(22) Filed: Dec. 11, 2023

(65) Prior Publication Data

US 2025/0188802 A1 Jun. 12, 2025

(51) Int. Cl.
*E21B 7/06* (2006.01)
*E21B 33/129* (2006.01)
*E21B 34/14* (2006.01)

(52) U.S. Cl.
CPC ..... *E21B 7/061* (2013.01); *E21B 33/1293* (2013.01); *E21B 34/14* (2013.01)

(58) Field of Classification Search
CPC ..... E21B 7/061; E21B 29/06; E21B 41/0035; E21B 34/14; E21B 33/1293
See application file for complete search history.

(56) References Cited

U.S. PATENT DOCUMENTS

| | | | | |
|---|---|---|---|---|
| 4,765,404 | A | 8/1988 | Bailey et al. | |
| 2002/0170713 | A1 | 11/2002 | Haugen et al. | |
| 2003/0183388 | A1* | 10/2003 | Toulouse | E21B 23/0411 166/117.6 |
| 2020/0149370 | A1 | 5/2020 | Steele | |

FOREIGN PATENT DOCUMENTS

| | | |
|---|---|---|
| AU | 2017225085 | 8/2018 |
| CA | 2652265 | 11/2007 |
| CA | 2992609 | 7/2018 |

* cited by examiner

*Primary Examiner* — Tara Schimpf
*Assistant Examiner* — Lamia Quaim
(74) *Attorney, Agent, or Firm* — Fish & Richardson P.C.

(57) ABSTRACT

A whipstock assembly and a method for side-tracking a wellbore. The whipstock assembly includes a casing sub-assembly. The casing sub-assembly has a first rotating collar, a second rotating collar, and multiple bars. The bars are movable from a first position spaced apart from the first and second rotating collars to a second position extending between the first rotating collar and the second rotating collar. The bars are rotatable from the second position to a third position to open a window in the bars and form a ramp oriented toward the window.

20 Claims, 5 Drawing Sheets

SIDE-TRACKING A WELLBORE

TECHNICAL FIELD

This disclosure relates to side-tracking a wellbore, for example, with a whipstock assembly.

BACKGROUND

Hydrocarbons are trapped in reservoirs in subterranean formations of the Earth. Wellbores are drilled through the subterranean formations to those reservoirs to raise the hydrocarbons to the surface of the Earth. Sometimes, an operator may side-track from an existing wellbore into the subterranean formations, that is, the operator can drill another wellbore off-shooting from an existing wellbore. A whipstock assembly can be placed in the existing wellbore to change the direction of a drilling assembly so the drilling assembly can deviate from the existing wellbore into the subterranean formations.

SUMMARY

This disclosure describes technologies related to side-tracking a wellbore. A whipstock assembly can be placed in the wellbore to orient a drilling bottom hole assembly so that a drill bit contacts and drills into the inner surface of the wellbore. The drilling bottom hole assembly drills the side-track wellbore branching off from the wellbore.

The whipstock assembly of the present disclosure can be run in the wellbore along with the drilling bottom hole assembly or a casing assembly. The whipstock assembly can be operated to engage to the inner surface of the wellbore, then actuated to form a ramp and a window to receive and redirect the drilling bottom hole assembly into the inner surface of the wellbore to side-track the wellbore.

Implementations of the present disclosure can realize one or more of the following advantages. For example, this approach can place the whipstock assembly using the casing sub-assembly, avoiding the need to place a cement plug. A cement plug can be placed in the wellbore below the side-track location as a seating surface for placing a conventional whipstock. By placing the whipstock assembly with the casing sub-assembly with packers and external anchors, a cement plug in the wellbore is no longer needed. For example, this approach can place the whipstock assembly using the casing sub-assembly, avoiding the need to dispose a drilling bottom hole assembly in the wellbore below the side-track location as a seating surface for placing the conventional whipstock. By placing the whipstock assembly with the casing sub-assembly with packers and external anchors, drilling a ledge in the wellbore is no longer needed, reducing the time required to side-track a wellbore. For example, this approach can open a window in the whipstock assembly by fracturing a tubular body of the casing sub-assembly, avoiding the need for a milling assembly to mill the window. For example, this approach can open a window in the whipstock assembly by fracturing a tubular body of the casing sub-assembly, avoiding the need for a cleanout operation after milling the window. Cleanup operations can be used to remove junk created from milling the window from the wellbore. This approach can reduce the complexity of wellbore drilling and completion operations can be reduced. Avoiding these drilling and completion operations can, in some cases, reduce the time required to side-track the wellbore by up to or more than two to three days.

This approach can also improve personnel safety. For example, this approach avoids cementing the wellbore with a plug or drilling a ledge to place a whipstock, reducing physical risks to personnel side-tracking the wellbore.

This approach can also improve a quality of the completion. For example, this approach can form a window in the casing sub-assembly by repositioning multiple bars, avoiding milling operations which can create large amounts of junk in the wellbore. Some milling operations can inadvertently mill through drill collars or centralizers, generating excessive junk in the wellbore. Additionally, forming the window in the casing sub-assembly by repositioning multiple bars, can avoid a poor or irregularly shaped window causing a bottom hole assemblies or completion assemblies used in later drilling or completion operations to hang up on the window. By side-tracking the wellbore with the whipstock assembly, completion quality can be improved.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes a whipstock assembly and a method for side-tracking a wellbore with the whipstock assembly. Sometimes, a wellbore requires side-tracking, that is, drilling another wellbore branching off from the wellbore. For example, sometimes a side-tracking operation is planned by drilling a main vertical wellbore, then drilling a lateral wellbore from main vertical wellbore. In another example, a drilling assembly or completion assembly can become stuck in the wellbore, and another wellbore can be drilled from the wellbore from a location uphole from the stuck drilling assembly or stuck completion assembly. Both open hole and cased hole wellbores can be side-tracked.

Figure 1:
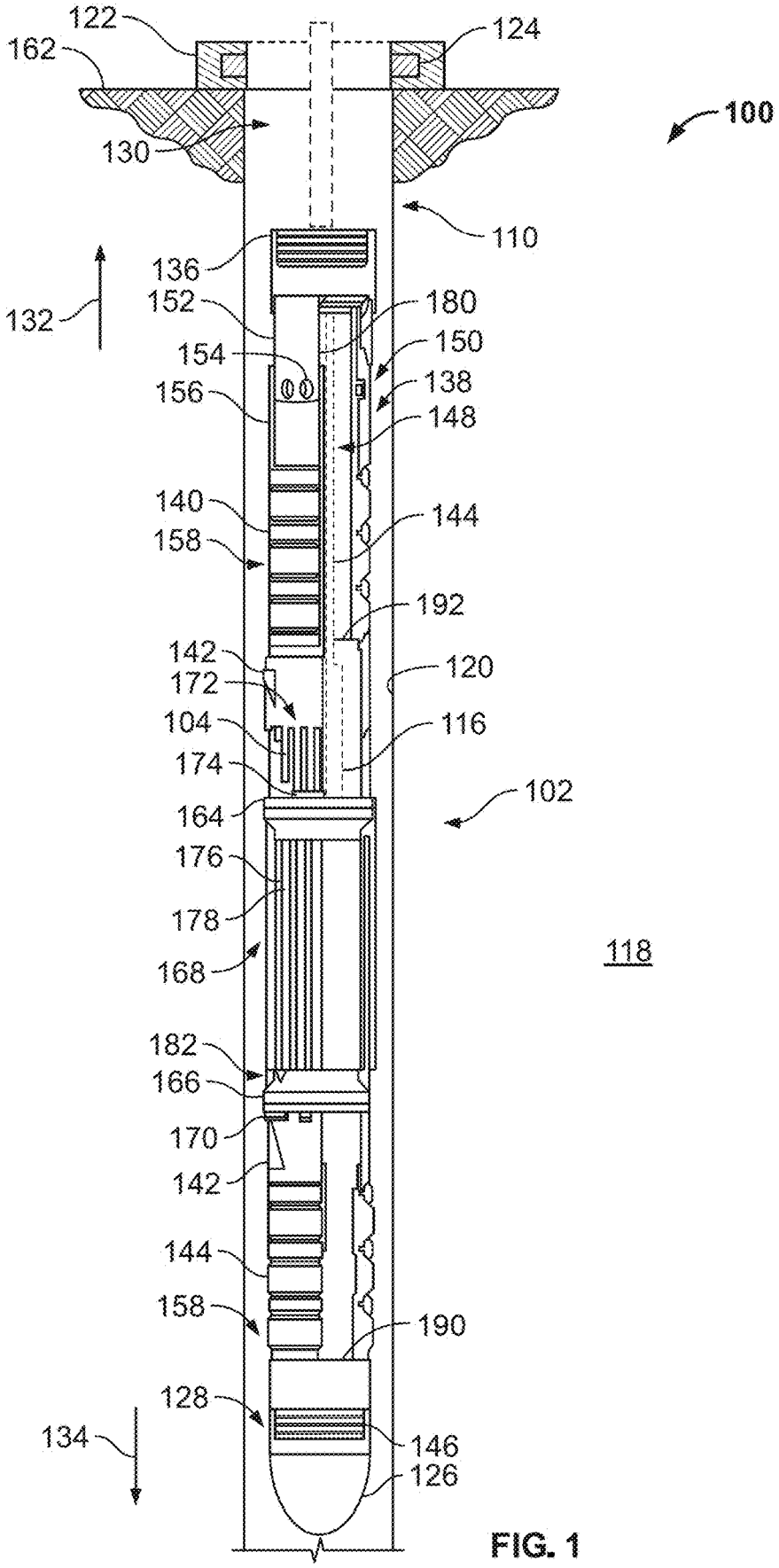
FIG. 1 is a schematic view of a whipstock assembly with a casing sub-assembly having multiple bars in a first position.
Figure 2:
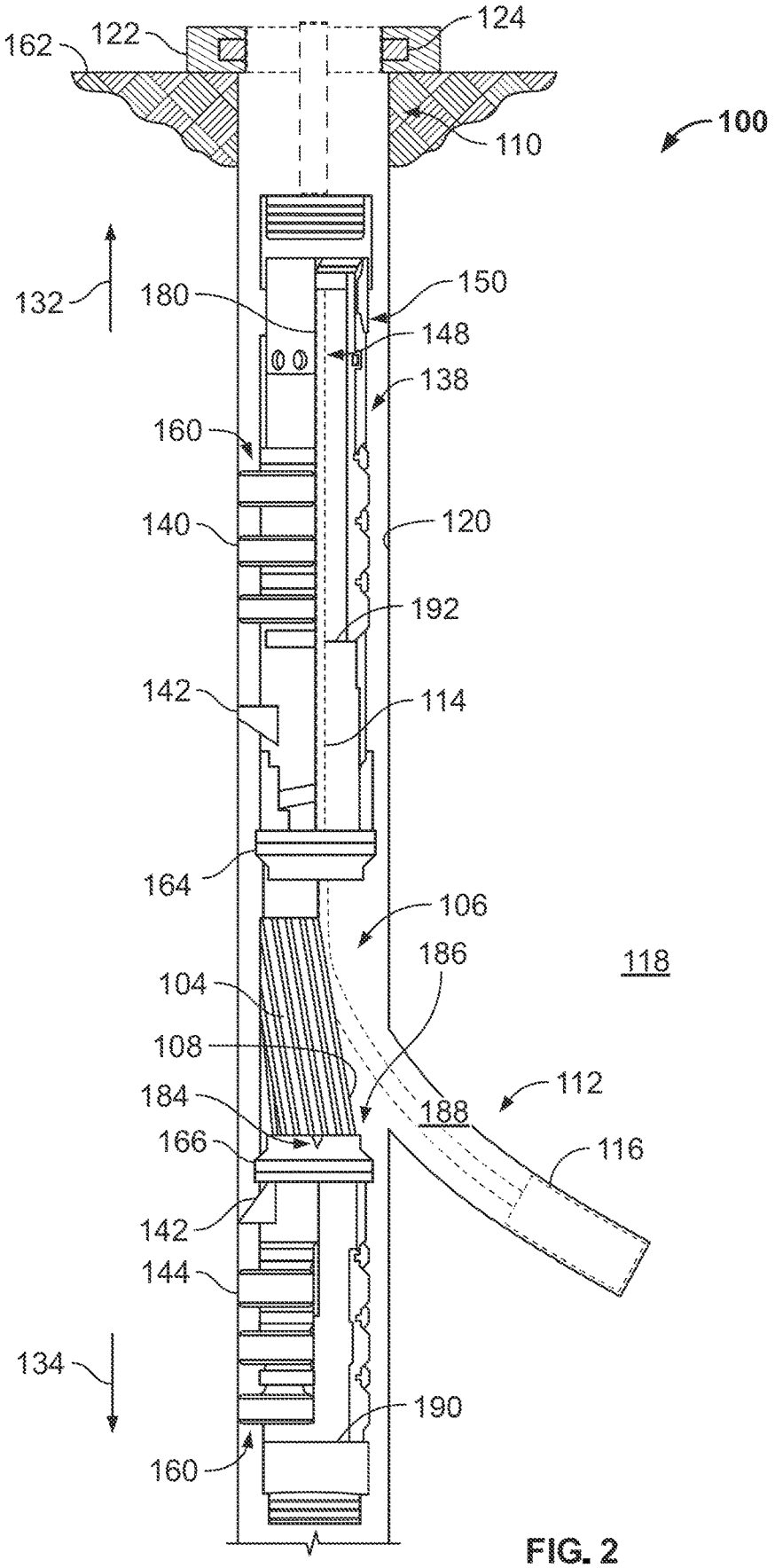
FIG. 2 is a schematic view of the whipstock assembly of FIG. 1 with the bars in a position to form a window and a ramp.

FIG. 1 is a schematic view of a whipstock assembly 100 with a casing sub-assembly 102 having multiple bars 104. FIG. 2 is a schematic view of the whipstock assembly 100 with the bars 104 in a position to form a window 106 and a ramp 108. The whipstock assembly 100 includes the casing sub-assembly 102 with a first rotating collar 164, a second rotating collar 166, a tubular body 168, and multiple bars 104. The bars 104 move from a first position 172 spaced apart from the first and second rotating collars 164, 166 to a second position extending between the first rotating collar 164 and the second rotating collar 166, and rotate from the second position to a third position 186 to open the window 106 in the bars 104 and to form the ramp 108 oriented toward the window 106. The ramp 108 changes an orientation of a drill bit 116 attached to a bottom hole assembly 114 passing through the whipstock assembly 100 and directs the drill bit 166 out window 106 to contact an inner surface 120 of the wellbore 110 and drill a side-track wellbore 112 from the wellbore 110.

The whipstock assembly 100 is positioned in the wellbore 110 to side-track the wellbore 110, that is, to drill the side-track wellbore 112 (shown in FIG. 2) from the wellbore 110. The side-track wellbore 112 is drilled by kicking off the drilling bottom hole assembly 114 having the drill bit 116 from the wellbore 110 into the subterranean formations 118 surrounding the wellbore 110. In some implementations, the drilling bottom hole assembly 114 is a directional bottom hole assembly. For example, the directional bottom hole assembly can have a mud motor with a bend.

The wellbore 110 is drilled from a surface 162 of the Earth into subterranean formations 118. The wellbore 110 has an inner surface 120. The wellbore 110 conducts fluids such as hydrocarbons and water contained in the subterranean formations 118 to the surface 162. In some implementations, the wellbore 110 is an open hole wellbore, in other words, the inner surface 120 of the wellbore is the subterranean formations 118. In other implementations, the wellbore 110 can be a cased hole, that is, the wellbore 110 can include a casing such as steel or steel and cement at the inner surface 120 of the wellbore 110.

A wellhead assembly 122 including a blowout preventer 124 can be positioned on the surface 162 of the Earth to control fluid flow to and from the wellbore 110 and seal the wellbore 110. The blowout preventer 124 can seal about the drilling bottom hole assembly 114 when the drilling bottom hole assembly 114 is positioned in the wellbore 110.

In order to side-track the wellbore 110, for example, when the wellbore 110 is blocked by a stuck drill pipe or another stuck bottom hole assembly, the drilling bottom hole assembly 114 is coupled to the whipstock assembly 100 and positioned within the wellbore 110. A guide shoe 126 is coupled to a downhole end 128 of the whipstock assembly 100 to guide the whipstock assembly 100 through the wellbore 110. The drilling bottom hole assembly 114 extends from an uphole end 130 of the drilling bottom hole assembly 114 opposite the downhole end 128. The uphole end 130 of the drilling bottom hole assembly 114 is toward the surface 162 in an uphole direction 132. The downhole end of the drilling bottom hole assembly 114 is away from the surface 162 in a downhole direction 134.

The whipstock assembly 100 includes an uphole connector 136, an auxiliary circulation sub-assembly 138, a top hydraulic packer 140, external anchors 142, the casing sub-assembly 102, a bottom hydraulic packer 144, and a downhole connector 146. The whipstock assembly 100 is placed in the wellbore 110 at a desired depth and operated to reorient the drill bit 116 to side-track the wellbore 110 in a desired direction.

The uphole and downhole connectors 136, 146 can couple to other downhole components. For example, the downhole connector 146 couples the guide shoe 126. In other implementations, a float shoe can be coupled to the downhole connector 146. As described in more detail in reference to FIG. 4, the uphole and downhole connectors 136, 146 can be coupled to casing joints as part of a casing assembly.

In this implementation, the uphole and downhole connectors 136, 146 are box and pin connectors. However, in other implementations, the uphole and downhole connectors 136, 146 can be any type of rotary shouldered connection. For example, uphole and downhole connectors 136, 146 can be a standard API (American Petroleum Institute) pin connection such as a regular connection, a numeric connection, an internal flush connection, or a full hole connection. In some implementations, the uphole and downhole connectors 136, 146 are a manufacturer proprietary design. In some implementations, the uphole and downhole connectors 136, 146 are a box connection, where the threads are internal to the box. The uphole and downhole connectors 136, 146 can have an outer diameter corresponding to a standard American Petroleum Institute connection size. For example, the uphole and downhole connectors 136, 146 can have an outer diameter of 2⅜ inches, 2⅞ inches, 3½ inches, 4½ inches, 5½ inches, 6⅝ inches, 7⅝ inches, or 8⅝ inches.

The auxiliary circulation sub-assembly 138 controls fluid flow from an internal void 148 within the whipstock assembly 100 to a space 150 exterior to the whipstock assembly 100. When the whipstock assembly 100 is positioned in the wellbore 110, the space 150 is a wellbore annulus defined by the inner surface 120 and the whipstock assembly 100. The auxiliary circulation sub-assembly 138 is coupled between the uphole connector 136 and the top hydraulic packer 140.

The auxiliary circulation sub-assembly 138 has a cylindrical body 152 defining the internal void 148, one or more ports 154 extending from the internal void 148 through the cylindrical body 152 to the space 150 exterior the cylindrical body 152, and a sleeve 156 actuatable to control fluid flow through the ports 154. The internal void 148 is sized to allow the drilling bottom hole assembly 114 and the drill bit 116 to pass. The internal void 148 also conducts drilling fluid through the whipstock assembly 100. In some cases, the drilling fluid includes lost circulation material. The ports 154 can be sized to allow the lost circulation material to pass from the internal void 148 to the wellbore annulus 150. The sleeve 156 is positioned about the cylindrical body 152. The sleeve 156 is actuatable to move between an open position preventing fluid flow through the ports 154 and a closed position preventing fluid flow through the ports 154. In some implementations, the sleeve 156 can move in either the uphole direction 132 or the downhole direction 134 to control fluid flow through the ports 154. In other implementations, the sleeve 156 can rotate relative to the cylindrical body 152 to control fluid flow through the ports 154.

The auxiliary circulation sub-assembly 138 can be included or not included depending on the application. Applications requiring cementing will have the ports 154 of the auxiliary circulation sub-assembly 138 activated by shifting down the sleeve 156 after dropping the ball and setting the packers 140, 144. Applications not requiring cementing allow the whipstock assembly 100 to be run in the wellbore 110 without auxiliary circulation sub-assembly 138. The auxiliary circulation sub-assembly 138 can be included in the whipstock assembly 100 in case it is required to pump or flow clean lost circulation material with the drilling fluid to plug a lost circulation zone in the subterranean formations 118. The auxiliary circulation sub-assembly 138 can be removed in cases where drilling fluid losses from the wellbore 110 into the subterranean formations 118 are less than a drilling fluid loss threshold. In some cases, the sleeve 156 can be actuated by hydraulic pressure or mechanical pressure from a dropping a ball or a dart to shift the sleeve 156 to close the ports 154.

The top and bottom hydraulic packers 140, 144 are shown in a partial cross-sectional view in FIGS. 1 and 2, also showing the internal void 148. The top hydraulic packer 140 is positioned toward the uphole end 130 of the whipstock assembly 100 between the auxiliary circulation sub-assembly 138 and the casing sub-assembly 102. The bottom hydraulic packer 144 is positioned toward the downhole end 128 of the whipstock assembly 100 between the casing sub-assembly 102 and the downhole connector 146. The top and bottom hydraulic packers 140, 144 are operable between a first position 158 (shown in FIG. 1) disengaged from the inner surface 120 of the wellbore 110 to a second position 160 (shown in FIG. 2) engaged to the inner surface 120 of the wellbore 110. When in the second position 160, the top and bottom hydraulic packers 140, 144 seal to the inner surface 120. When the top and bottom hydraulic packers 140, 144 are engaged to the inner surface 120 of the wellbore 110, fluid flow through the wellbore 110 between the uphole end 130 and the downhole end 128 through the wellbore annulus 150 is prevented.

The top and bottom hydraulic packers 140, 144 can be operated by a setting tool. The top and bottom hydraulic packers 140, 144 can be operated by dropping a ball into the whipstock assembly 100 to interrupt fluid flow. Interrupting the fluid flow to the top and bottom hydraulic packers 140, 144 can increase a pressure of the top and bottom hydraulic packers 140, 144 above a pressure threshold, actuating the packers from the first position 158 to the second position 160. In some cases, the top and bottom hydraulic packers 140, 144 can be inflated to move from the first position 158 to the second position 160.

The top and bottom hydraulic packers 140, 144 can be operated simultaneously or independently (i.e., at different times). For example, the setting tool can be included to actuate the bottom hydraulic packer 144 from the first position 158 to the second position 160, and then later actuate the top hydraulic packer 140 from the first position 158 to the second position 160. For example, the operator can drop a first ball having a first diameter into the whipstock assembly 100 from the surface 162 to a bottom hydraulic packer ball seat 190 to stop fluid flow and increase pressure above the pressure threshold at the bottom hydraulic packer 144. Responsive to the pressure at the bottom hydraulic packer 144 increasing above the pressure threshold, the bottom hydraulic packer 144 actuates from the first position 158 to the second position 160. Likewise, the operator can drop a second ball having a second diameter greater than the first diameter of the first ball into the whipstock assembly 100 from the surface 162 to a top hydraulic packer ball seat 192 to stop fluid flow and increase pressure above the pressure threshold at the top hydraulic packer 140. Responsive to the pressure at the top hydraulic packer 140 increasing above the pressure threshold, the top hydraulic packer 140 actuates from the first position 158 to the second position 160. Alternatively, the operator can drop a single ball to actuate both the top and bottom hydraulic packers 140, 144 simultaneously.

The external anchors 142 extend (as shown in FIG. 2) and retract (shown in FIG. 1) from the casing sub-assembly 102 to couple the whipstock assembly 100 in place within the wellbore 110 to the subterranean formations 118. The external anchors 142 are split into two sets, with one set positioned toward the downhole end 128 of the casing sub-assembly 102, and another set positioned toward the uphole end 130 of the casing sub-assembly 102. The external anchors 142 are sized to contact, and in some cases penetrate, the subterranean formations 118. As shown in FIGS. 1 and 2, the external anchors 142 are triangular, however, the external anchors 142 can be wedged or cone shaped to hold weight and prevent movement in multiple directions or even include features such as spikes or teeth to engage the subterranean formation 118. The external anchors 142 can be set, that is engaged and disengaged, by the setting tool or simultaneously with the respective top or bottom hydraulic packers 140, 144 by dropping the first ball or second ball. The external anchors 142 are configured to be activated hydraulically, but may also be self-energized from any force applied in any direction. After the open hole side-track wellbore is drilled, is the whipstock assembly 100 may be left in place. In some applications, the whipstock assembly 100 may be removed from the wellbore 110 by disengaging the external anchors 142.

The casing sub-assembly 102 is actuatable to form the window 106 and the ramp 108 to alter a direction of travel of the drill bit 116 and the drilling bottom hole assembly 114 to side-track the wellbore 110. The casing sub-assembly 102 includes a first rotating collar 164, a second rotating collar 166, a tubular body 168 extending between the first rotating collar 164 and the second rotating collar 166, and the multiple bars 104. The tubular body 168 can be fracturable. The casing sub-assembly 102 has a pin 170 that holds the bars 104 in a first position 172 spaced apart from the first and second rotating collars 164, 166. The casing sub-assembly 102 has a receptacle 174 for coupling to the drill bit 116 and transferring a slack-off weight from the drilling bottom hole assembly 114 to the pin 170 and rotational movement from the drilling bottom hole assembly 114 to the first and second rotating collars 164, 166. The bars 104 can be a metal, a steel, or a steel alloy. The size of the bars 104 can vary based on the desired departure angle and window size.

The tubular body 168 has guides 176 imbedded into the tubular body 168. For example, the guides 176 can be a series of voids extending through the tubular body 168 to receive and pass the bars 104 from the first rotating collar 164 to the second rotating collar 166. Alternatively, the guides 176 can be channels in an inner surface 178 of the tubular body 168 to direct the bars 104 from the first rotating collar 164 to the second rotating collar 166.

The tubular body 168 is drillable by a polycrystalline diamond compact drill bit. The tubular body 168 can be formed from a composite, a metal, or a metal alloy. For example, the tubular body 168 can be constructed from a rubber, a plastic, a resin, aluminum, steel, or steel alloy. Any non-metallic material may be used for the tubular body 168 as long as the material can withstand the rated pressure of the wellbore 110 and may be easily drillable without damaging the drill bit 116 under normal or design operating conditions.

The receptacle 174 is constructed from a material that is also drillable by a polycrystalline diamond compact drill bit (drill bit 116). The receptacle 174 is designed for commercially available drill bits (such as drill bit 116) to hydraulically seal, coupled to the drill bit 116 using the pins 170, and can be de-coupled by applying pre-determined weight force to break (shear) the pins 170.

The first and second rotating collars 164, 166 receive and couple to the bars 104. The first and second rotating collars 164, 166 are initially locked from rotation until it is deployed to the desired depth in the wellbore 110, and then activated by applying slack-off weight freeing the first and second rotating collars 164, 166 to rotate. With downward movement and rotation, the bars 104 are guided to fixed locations that lock with the first and second rotating collars 164, 166 and lock rotation. After receiving the bars 104, the first and second rotating collars 164, 166 rotate, responsive to a rotational force applied to the first and second rotating collars 164, 166, from the drilling bottom hole assembly 114 from a first position 182 (shown in FIG. 1) to a second position 184 (shown in FIG. 2), forming the window 106 and the ramp 108. When the first and second rotating collars 164, 166 are moved into the second position 184, the first and second rotating collars 164, 166 are locked, confirming the bars 104 are formed into the ramp 108 and the window 106 is fully open. Some additional breaking or extrusion of the tubular body 168 may occur as the bars 104 move to form the window 106 and the ramp 108.

The bars 104 move from the first position 172 (shown in FIG. 1) spaced apart from the first and second rotating collars 164, 166 to a second position extending between the first rotating collar 164 and the second rotating collar 166 generally along a center axis 180 of the whipstock assembly. The bars 104 are moved from the first position 172 to the second position by the drilling bottom hole assembly 114. The drilling bottom hole assembly 114 applies weight to the receptacle 174, which, when the weight reaches a predefined slack-off weight equal to or greater than a slack-off weight threshold, shears the pin 170 and shift the bars 104 in the downhole direction 134 into the tubular body 168. The bars 104 slide along or within the imbedded guides 176 until the bars 104 fully extend between the first and second rotating collars 164, 166. This also fractures the receptacle 174, releasing the drill bit 116 from the receptacle 174 and simultaneously breaking the tubular body 168 and forming the window 106.

Subsequently, while maintaining the slack-off weight equal to or greater than the slack-off weight threshold, the drilling bottom hole assembly 114 is rotated, to the right (i.e., in a clockwise direction) and rotating the first and second rotating collars 164, 166 from the first position 182 to the second position 184 where the first and second rotating collars 164, 166 move the bars 104 from the second position aligned to the center axis 180 to the third position 186 (shown in FIG. 2) angled relative to the center axis 180, forming the ramp 108 with the bars 104 and fully opening the window 106. The bars 104 are rotated by downward movement and following the guides 176 (channels) without rotating the bottom hole assembly 114 by the drill bit 116.

In some cases, the size of the window 106 can be determined based on a ratio of a volume of the tubular body 168 to a volume of the bars 104. For example, a 60% bar 104 volume and 40% tubular body 168 volume can result in a 40% relative window 106 size. The volume ratio can be modified as desired by the application.

The ramp 108 is now oriented toward the window 106 and angled to receive the drill bit 116. The ramp 108 reorients the drill bit 116 off the center axis 180 and toward the window 106 toward the inner surface 120 of the wellbore 110.

As weight is further applied to the drill bit 116 and the drill bit 116 continues to rotate, the drill bit 116 passes through the window 106 and contacts the inner surface 120 of the wellbore 110. The drill bit 116 removes a portion 188 of the subterranean formations 118, forming the side-track wellbore 112.

Figure 3:
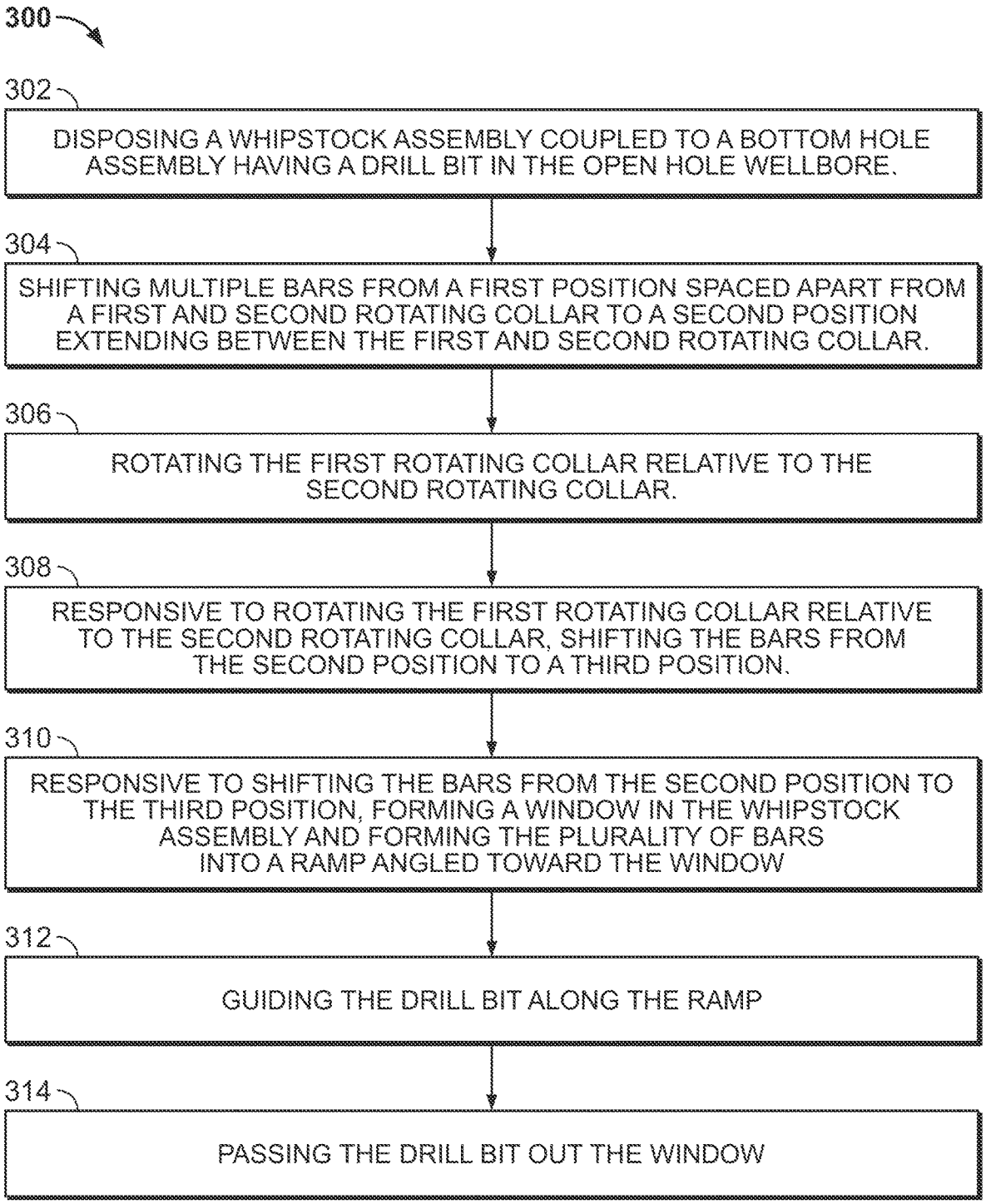
FIG. 3 is a flow chart of an example method of side-tracking an open hole wellbore according to the implementations of the present disclosure.

FIG. 3 is a flow chart of an example method 300 of side-tracking an open hole wellbore according to the implementations of the present disclosure. The method 300 is described with reference to the whipstock assembly 100 shown in FIGS. 1 and 2, but can be implemented with other whipstock assemblies. At 302, a whipstock assembly coupled to a bottom hole assembly having a drill bit is disposed in the open hole wellbore. Disposing the whipstock assembly 100 and the bottom hole assembly 114 in the open hole wellbore 110 can include coupling the drill bit 116 at the receptacle 174 of the whipstock assembly 100. A guide shoe 126 can be coupled to the downhole end 128 of the whipstock assembly 100. Disposing the whipstock assembly 100 and the bottom hole assembly 114 in the open hole wellbore 110 can include positioning the whipstock assembly 100 and the bottom hole assembly 114 in the open hole wellbore 110. For example, the whipstock assembly 100 can be placed at the desired depth where the wellbore 110 is to be side-tracked. The whipstock assembly 100 can be rotated by the drilling bottom hole assembly 114 such that when the window 106 and the ramp 108 are formed, the drill bit 116 can exit the window 106 and contact the inner surface 120 of the wellbore 110 at the planned orientation to drill the side-track wellbore 112 according to a well plan.

Disposing the whipstock assembly 100 and the bottom hole assembly 114 in the open hole wellbore 110 can include coupling the whipstock assembly 100 to the wellbore 110. For example, the packers 140, 144 and the external anchors 142 can be extended by dropping a ball into the whipstock assembly 100 from the surface 162. The ball can include multiple balls of different diameters. The ball can be received on the ball seat (one or both of 190, 192), closing a circulation path through the whipstock assembly. Closing the circulation path increases a pressure within the whipstock assembly 100 equal to or greater than a threshold pressure. Responsive to increasing the pressure equal to or greater than the threshold pressure at the packers 140, 144, the packers 140, 144 are set and the external anchors 142 are extended from the whipstock assembly 100 to contact the inner surface 120 of the wellbore 110.

At 304, multiple bars of the whipstock assembly shift from a first position spaced apart first and second rotating collars to a second position extending between the first and second rotating collar. Shifting the bars 104 of the whipstock assembly 100 from the first position to the second position extending between the first and second rotating collar can include receiving slack-off weight of the bottom hole assembly 114 at the pin 170 retaining a first rotating collar 164 and a second rotating collar 166 in a first position 182. The first rotating collar 164 and a second rotating collar 166 transfer the slack-off weight of the drilling bottom hole assembly 114 to the pin 170. Responsive to the slack-off weight at the pin 170 equal to or greater than the slack-off weight threshold, the pin 170 shears. Responsive to the pin 170 shearing, the bars 104 move from the first position 172 to extend through the first rotating collar 164 to the second rotating collar 166. The receptacle 174 is fractured. In some implementations, moving the bars 104 through the first rotating collar 164 to the second rotating collar 166 fractures the tubular body 168.

At 306, the first rotating collar and the second rotating collar are rotated relative to each other. While rotating, the drill bit 116 and the drilling bottom hole assembly 114 can contact the first rotating collar 164 and the second rotating collar 166, causing the first rotating collar 164 to the second rotating collar 166 to rotate.

At 308, responsive the first rotating collar relative to the second rotating collar rotating, the bars shift from the second position to a third position. The bars 104 shift from the second position to the third position 186.

At 310, responsive to shifting the bars from the second position to the third position, a window is formed in the whipstock assembly and the bars form into a ramp angled toward the window. The bars 104 move to and lock in the third position 186. The bars 104 form the ramp 108 and open the window 106 in the casing sub-assembly 102.

At 312, the ramp guides the drill bit through the casing sub-assembly 102. Simultaneously, a weight is applied to the drill bit 116 and the drill bit 116 is rotated by the drilling bottom hole assembly 114. The drill bit 116 contacts and slides along the ramp 108 and is reoriented toward the window 106.

At 314, the drill bit passes out the window. The drill bit 116 exits the window 106 to contact the inner surface 120 of the wellbore 110. As the drill bit 116 continues to rotate, the drill bit 116 drills the portion 188 of the subterranean formation 118 extending from the inner surface 120 of the wellbore 110 to side-track the wellbore 110.

Figure 4:
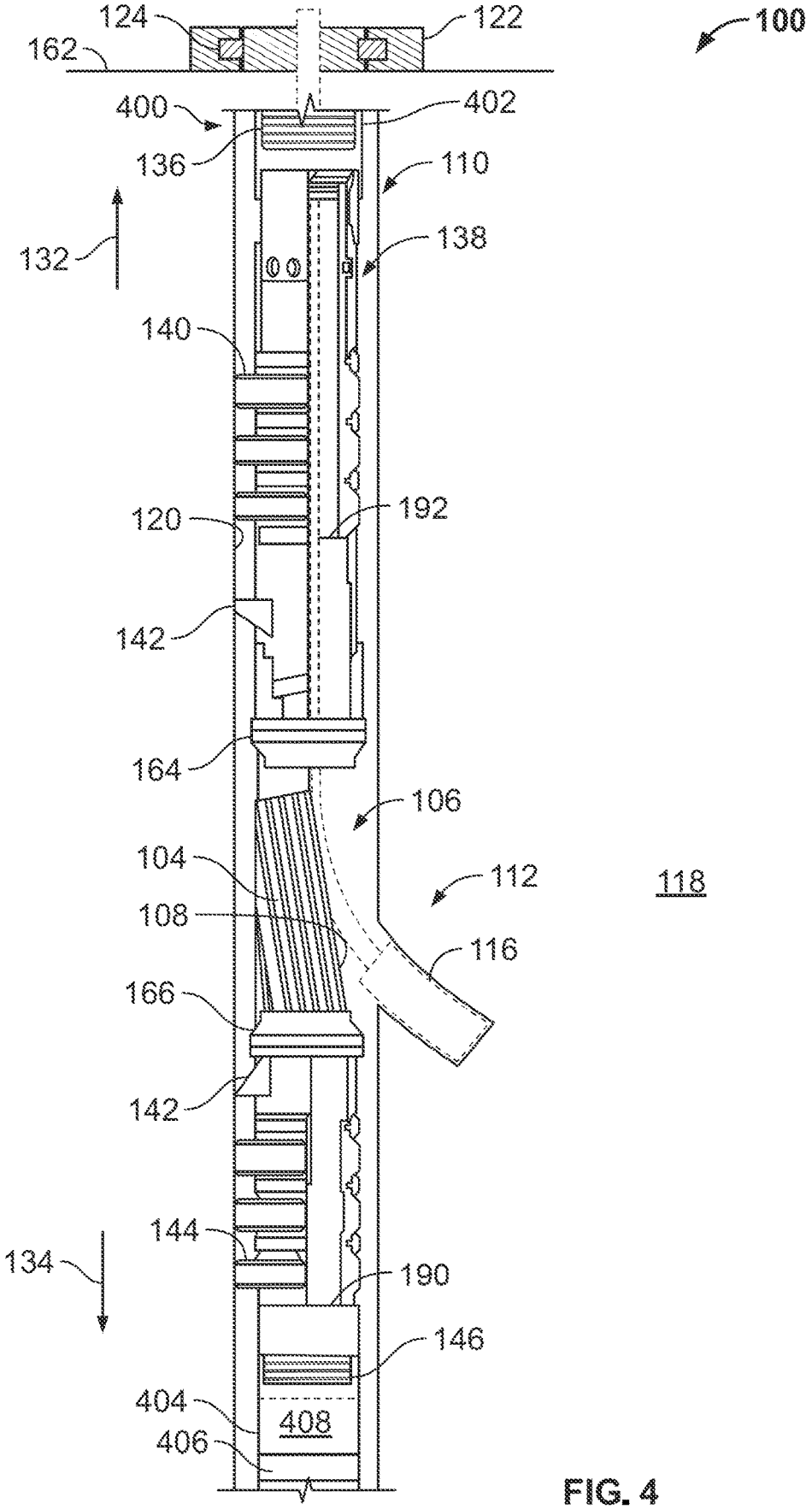
FIG. 4 is a schematic view of a casing assembly including the whipstock assembly of FIG. 1.

FIG. 4 is a schematic view of a casing assembly 400 including the whipstock assembly 100 for side-tracking the wellbore 110. Side-tracking the wellbore 110 while casing (positioning the casing assembly 400 in the wellbore 110) can be accomplished using the whipstock assembly 100 coupled to the casing assembly 400. That is, the whipstock assembly 100 can be included in-between sections of the casing assembly 400. The whipstock assembly 100 used with the casing assembly 400 for a planned side-track of the wellbore 110.

The casing assembly 400 includes an upper casing 402 extending from the whipstock assembly 100 in the uphole direction 132 to the wellhead assembly 122 at the surface 162 and a lower casing 404 extending in the downhole direction 134 from the whipstock assembly 100. The upper casing 402 can be coupled to the uphole connector 136 at the uphole end 130 of the whipstock assembly 100 and the lower casing 404 by the downhole connector 146 at the downhole end 128 of the whipstock assembly 100.

In some implementations, the upper and lower casings 402, 404 can be casing liner. Additional tools such as a wiper plug 406 and cement can be used to complete the wellbore 110 in this cased hole implementation. In some cases, cementing the wellbore 110 can be performed in one or two stages. In some cases, cementing the first stage volume is performed by calculating a cement volume to flow cement to have the top of cement below the bottom packer 144.

Figure 5:
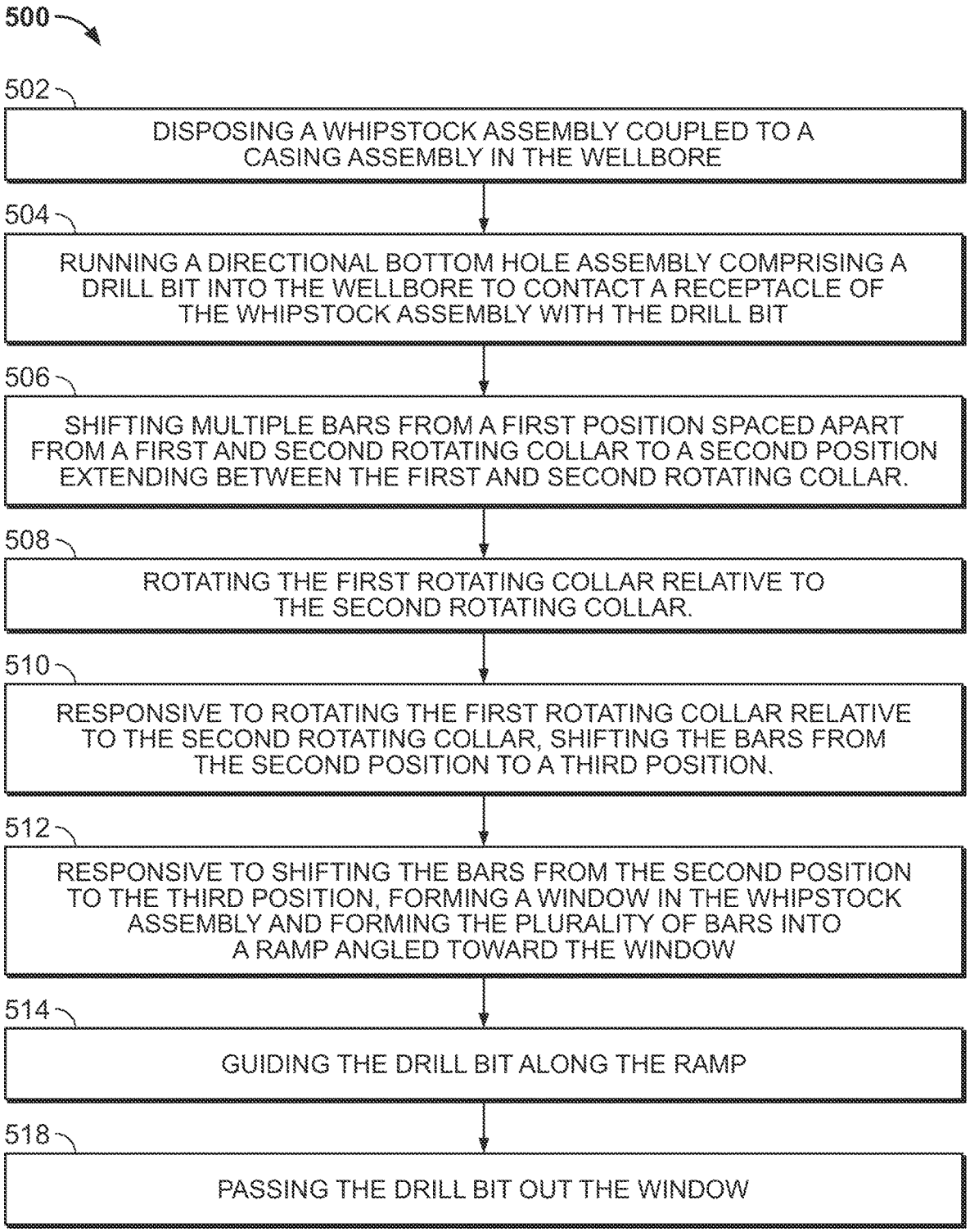
FIG. 5 is a flow chart of an example method of side-tracking a cased hole wellbore according to the implementations of the present disclosure.

FIG. 5 is a flow chart of an example method of side-tracking a cased hole wellbore according to the implementations of the present disclosure. The method 500 is described with reference to the whipstock assembly 100 shown in FIGS. 1, 2, and 4 but can be implemented with other whipstock assemblies. At 502, a whipstock assembly coupled to a casing assembly is positioned in the wellbore. At the surface 162 of the Earth, the whipstock assembly 100 is coupled to the upper casing 402 by the uphole connector 136 at the uphole end of the whipstock assembly 100 and the lower casing 404 by the downhole connector 146 at the downhole end 128 of the whipstock assembly 100. The whipstock assembly 100 and the casing assembly 400 are positioned in the wellbore 110 by a rig. The whipstock assembly 100 is placed at the depth in the wellbore 110 where a side-track wellbore 112 is desired. The whipstock assembly 100 can be oriented in the wellbore 110 such that when the whipstock assembly 100 is rotated, the window 106 and the ramp 108 are formed to position the drill bit 116 relative to the wellbore 110 so that the drill bit 116 exits the window 106 and contacts the inner surface 120 of the wellbore 110 at the planned orientation to drill the side-track wellbore 112 according to a well plan.

Cement can be pumped through the casing assembly 400 and whipstock assembly 100. Cement can be pumped from the surface 162, down the casing assembly 400 and the whipstock assembly 100, out the downhole end 128 and into the wellbore 110. In some implementations, the cement is pumped up the wellbore annulus 150 to a location downhole from the whipstock assembly 100. In some implementations, the cement is pumped up the wellbore annulus 150 past the whipstock assembly 100 to the surface 162.

The wiper plug 406 can be conducted through the internal void 148 and in contact with inner surfaces of the casing assembly 400 and the whipstock assembly 100 to clean wet cement from the inner surfaces of the casing assembly 400 and the whipstock assembly 100. The wiper plug can be installed in the casing assembly 400. For example, the wiper plug 406 can be installed in the lower casing 404 in downhole direction 134 from the whipstock assembly 100.

A retarded fluid can be pumped into the casing assembly 400, through the whipstock assembly 100, and to the wiper plug 406. The retarded fluid can be pumped from the surface 162 into the casing assembly 400 and the whipstock assembly 100 to fill a space 408 from the wiper plug 406 to the surface 162 with retarded fluid to prevent any remaining cement from drying and impacting whipstock assembly 100 operations. After a pre-determined time period, the directional bottom hole assembly 114 and drill bit 116 can be passed into the wellbore. The pre-determined time period allows the cement to set. The cement can be allowed to set, and then the drilling bottom hole assembly 114 and the drill bit 116 are positioned in the wellbore, offset from the receptacle 174. An uphole portion of the casing assembly 400 is cleaned out by the directional bottom hole assembly 114. For example, the drilling fluid is pumped through the drilling bottom hole assembly 114 and out the drill bit 116 into the internal void 148 and within the space 408 of the lower casing 404 to the surface 162.

A pressure test of the cemented casing assembly 400 and whipstock assembly 100 can be performed. A pump on the surface 162 can increase a pressure inside the casing assembly 400 to a pressure test threshold range for a pre-determined time period. The pressure test threshold range is less than a setting pressure for the whipstock assembly 100. That is, a pressure in the pressure test threshold range will not set the packers 140, 144.

At 504, the directional bottom hole assembly is run in hole to contact a receptacle of the whipstock assembly. The drilling bottom hole assembly 114 can be moved in the downhole direction 134 to contact the receptacle 174.

In some implementations, the whipstock assembly 100 can be further coupled to the wellbore 110. For example, the packers 140, 142 and the external anchors 142 can couple to the cement or the inner surface 120 of the wellbore 110. The packers 140, 142 and the external anchors 142 can be set by closing the blowout preventer 124 positioned in the wellhead assembly 122 to seal about the drilling bottom hole assembly 114 at the surface 162. An inner pressure of the casing assembly 400 and the whipstock assembly 100 can be increased to a packer set pressure is increased. The pressure within the internal void 148 and within the space 408 of the lower casing 404 to the surface 162 can be raised by a pump at the surface 162 to the packer set pressure. Responsive to increasing the inner pressure of the casing assembly 400 and the whipstock assembly 100 to the packer set pressure, the packers 140, 144 are set, engaging the packers 140, 144 to the cement or wellbore 110 and external anchors 142 are extended from the whipstock assembly 100. Alternatively or in addition, one or more of the packers 140, 144 or the external anchors 142 can be extended by dropping a ball into the whipstock assembly 100 from the surface 162. The ball can be received on the ball seat, closing a circulation path through the whipstock assembly 100. Closing the circulation path increases a pressure within the whipstock assembly 100 equal to or greater than a threshold pressure. Responsive to increasing the pressure equal to or greater than the threshold pressure at the packers 140, 144, the packers 140, 144 are set and the external anchors 142 are extended from the whipstock assembly 100 to contact the inner surface 120 of the wellbore 110.

At 506, multiple bars of the whipstock assembly shift from a first position spaced apart first and second rotating collars to a second position extending between the first and second rotating collar. Shifting the bars of the whipstock assembly from the first position to the second position extending between the first and second rotating collar can include receiving slack-off weight of the bottom hole assembly 114 at the pin 170 retaining a first rotating collar 164 and a second rotating collar 166 in a first position 182. The first rotating collar 164 and a second rotating collar 166 transfer the slack-off weight of the drilling bottom hole assembly 114 to the pin 170. Responsive to the slack-off weight at the pin equal to or greater than the slack-off weight threshold, the pin 170 shears. Responsive to the pin 170 shearing, the bars 104 move from the first position 172 to extend through the first rotating collar 164 to the second rotating collar 166. The receptacle 174 is fractured. In some implementations, moving the bars 104 through the first rotating collar 164 to the second rotating collar 166 fractures the tubular body 168.

At 508, the first rotating collar and the second rotating collar are rotated relative to each other. While rotating, the drill bit 116 and the drilling bottom hole assembly 114 can contact the first rotating collar 164 and the second rotating collar 166, causing the first rotating collar 164 to the second rotating collar 166 to rotate.

At 510, responsive the first rotating collar relative to the second rotating collar rotating, the bars shift from the second position to a third position. The bars 104 shift from the second position to the third position 186.

At 512, responsive to shifting the bars from the second position to the third position, a window is formed in the whipstock assembly and the bars form into a ramp angled toward the window. The bars 104 move to and lock in the third position 186. The bars 104 form the ramp 108 and open the window 106 in the casing sub-assembly 102.

At 514, the ramp guides the drill bit through the casing sub-assembly 102. Simultaneously, a weight is applied to the drill bit 116 and the drill bit 116 is rotated by the drilling bottom hole assembly 114. The drill bit 116 contacts and slides along the ramp 108 and is reoriented toward the window 106.

At 516, the drill bit passes out the window. The drill bit 116 exits the window 106 to contact the inner surface 120 of the wellbore 110. As the drill bit 116 continues to rotate, the drill bit 116 drills the portion 188 of the subterranean formation 118 extending from the inner surface 120 of the wellbore 110 to side-track the wellbore 110. In some implementations, the whipstock assembly 100 is oriented at the surface relative to the wellbore 110 such that the window 106, when formed, is oriented to toward the planned side-track wellbore 112.

EMBODIMENTS

In an example aspect, a whipstock assembly includes a casing sub-assembly. The casing sub-assembly includes a first rotating collar, a second rotating collar, and multiple bars. The bars are movable from a first position spaced apart from the first and second rotating collars to a second position extending between the first rotating collar and the second rotating collar. The bars are rotatable from the second position to a third position to open a window in the bars and form a ramp oriented toward the window.

In an example aspect combinable with any other example aspect, the ramp is angled to receive a drilling assembly and alter a direction of travel of the drilling assembly.

In an example aspect combinable with any other example aspect, the whipstock assembly includes a pin coupled the first rotating collar and the second rotating collar. The pin maintains the first rotating collar and the second rotating collar in a locked position. Responsive to the pin shearing, the first rotating collar and the second rotating collar are allowed to rotate to an unlocked position, rotating the bars from the second position to the third position, forming the ramp, and opening the window in the bars.

In an example aspect combinable with any other example aspect, the whipstock assembly includes a receptacle couplable to a drill bit of a bottom hole assembly. The receptacle is coupled to the pin to transfer weight from the bottom hole assembly to the pin.

In an example aspect combinable with any other example aspect, the whipstock assembly includes a tubular body extending between the first rotating collar and the second rotating collar.

In an example aspect combinable with any other example aspect, the the tubular body is fracturable responsive to receiving a slack-off weight equal to or greater than a slack-off weight threshold.

In an example aspect combinable with any other example aspect, the tubular body is further fracturable responsive to the first rotating collar and the second rotating collar rotating.

In an example aspect combinable with any other example aspect, the tubular body includes a material drillable by a polycrystalline diamond compact drill bit.

In an example aspect combinable with any other example aspect, the whipstock assembly includes a first hydraulic packer, a second hydraulic packer, and anchors. The first hydraulic packer is positioned at a first end of the whipstock assembly. The second hydraulic packer is positioned at a second end of the whipstock assembly. The second end is opposite the first end. At least one anchor is positioned between the casing sub-assembly and the first end and at least one anchor is positioned between the casing sub-assembly and the second end.

In an example aspect combinable with any other example aspect, the whipstock assembly includes a circulation sub-assembly to control a fluid flow from within the whipstock assembly to a space exterior the whipstock assembly. The circulation sub-assembly includes a cylindrical body, one or more ports, a sleeve, and an actuator. The cylindrical body defines an internal void. The one or more ports extend from the internal void through the cylindrical body to the space exterior the cylindrical body. The sleeve is positioned about the cylindrical body. The sleeve controls fluid flow through the one or more ports. The actuator is coupled to the sleeve. The actuator operates the sleeve between an open position and a closed position.

In another example, an open hole wellbore in a subterranean formation is side-tracked. Side-tracking the open hole wellbore includes disposing a whipstock assembly coupled to a bottom hole assembly includes a drill bit in the open hole wellbore. Side-tracking the open hole wellbore includes shifting bars from a first position spaced apart from a first and second rotating collar to a second position extending between the first and second rotating collar. Side-tracking the open hole wellbore includes rotating the first rotating collar relative to the second rotating collar. Side-tracking the open hole wellbore includes responsive to rotating the first rotating collar relative to the second rotating collar, shifting the bars from the second position to a third position. Side-tracking the open hole wellbore includes responsive to shifting the bars from the second position to the third position, forming a window in the whipstock assembly and forming the bars into a ramp angled toward the window. Side-tracking the open hole wellbore includes guiding the drill bit along the ramp. Side-tracking the open hole wellbore includes passing the drill bit out the window.

In an example aspect combinable with any other example aspect, before positioning the whipstock assembly coupled to the bottom hole assembly in the open hole wellbore, side-tracking the wellbore includes coupling the drill bit to a receptacle of the whipstock assembly.

In an example aspect combinable with any other example aspect, before positioning the whipstock assembly coupled to the bottom hole assembly in the open hole wellbore, side-tracking the wellbore includes receiving a shoe at a downhole end of the whipstock assembly.

In an example aspect combinable with any other example aspect, disposing the whipstock assembly coupled to the bottom hole assembly in the open hole wellbore includes receiving a ball at a ball seat of the whipstock assembly; responsive to receiving the ball at the ball seat, closing a circulation path through the whipstock assembly; responsive to closing the circulation path through the whipstock assembly, increasing a pressure equal to or greater than a threshold pressure; and responsive to increasing the pressure equal to or greater than the threshold pressure, setting multiple packers and extending and extending anchors from the whipstock assembly to engage the subterranean formation.

In an example aspect combinable with any other example aspect, shifting the bars from the first position spaced apart from the first and second rotating collars to the second position extending between the first and second rotating collar includes receiving a slack-off weight at a pin retaining the first rotating collar and the second rotating collar in the first position, the slack-off weight equal to or greater than a slack-off threshold; responsive to receiving the slack-off weight at the pin equal to or greater than a slack-off weight threshold, shearing the pin; and responsive to shearing the pin, shifting the plurality of bars from the first position to the second position and fracturing a receptacle coupling the drill bit to the whipstock assembly.

In an example aspect combinable with any other example aspect, after shearing the pin, side-tracking the wellbore includes drilling the receptacle with the drill bit.

In an example aspect combinable with any other example aspect, responsive to shifting the bars from the first position to the second position, side-tracking the wellbore includes fracturing a tubular body extending between the first rotating collar and the second rotating collar.

In an example aspect combinable with any other example aspect, rotating the first and second rotating collars to the second position locks the bars forming the ramp and the window.

In an example aspect combinable with any other example aspect, after guiding the drill bit along the ramp and passing the drill bit out the window, side-tracking the wellbore includes contacting the drill bit to an inner surface of the open hole wellbore; drilling, by the drill bit, a portion of the subterranean formation; and responsive to drilling the portion of the subterranean formation, sidetracking the open hole wellbore.

In yet another example, a wellbore is completed in a subterranean formation. Completing the wellbore includes disposing a whipstock assembly coupled to a casing assembly in the wellbore. Completing the wellbore includes running a directional bottom hole assembly including a drill bit into the wellbore to contact a receptacle of the whipstock assembly with the drill bit. Completing the wellbore includes shifting bars from a first position spaced apart from first and second rotating collars to a second position extending between the first and second rotating collar. Completing the wellbore includes rotating the first rotating collar relative to the second rotating collar. Completing the wellbore includes responsive to rotating the first rotating collar relative to the second rotating collar, shifting the bars from the second position to a third position. Completing the wellbore includes responsive to shifting the bars from the second position to the third position, forming a window in the whipstock assembly and forming the bars into a ramp angled toward the window, the ramp angled to guide the drill bit out the window. Completing the wellbore includes guiding the drill bit along the ramp. Completing the wellbore includes passing the drill bit out the window.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A whipstock assembly comprising:

a circulation sub-assembly configured to control a fluid flow from within the whipstock assembly to a space exterior the whipstock assembly, the circulation sub-assembly sized to allow a drilling bottom hole assembly comprising a drill bit to pass;

a casing sub-assembly, the casing sub-assembly coupled to a downhole end of the circulation sub-assembly, the casing sub-assembly comprising:

a fracturable receptacle;

a first rotating collar coupled to the fracturable receptacle downhole from the fracturable receptacle, the first rotating collar initially locked from rotation relative to the whipstock assembly and configured to rotate responsive to rotation of the drill bit;

a second rotating collar spaced apart from and downhole from the first rotating collar, the second rotating collar rotatable relative to the first rotating collar, the second rotating collar initially locked from rotation relative to the whipstock assembly, the second rotating collar configured to rotate responsive to rotation of the drill bit;

a tubular body positioned between the first rotating collar and the second rotating collar and defining a plurality of guides extending between the first rotating collar and the second rotating collar, the tubular body fracturable by both a transfer of a weight above a slack-off weight threshold weight from the drill bit through the fracturable receptacle and rotation of the first rotating collar and the second rotating collar; and a plurality of bars movable to a position aligned with a center axis of the whipstock assembly and extending between the first rotating collar and the second rotating collar in response to application of the weight above the slack-off weight threshold weight by the drilling bottom hole assembly and the drill bit, the plurality of bars held above the second rotating collar by the fracturable receptacle, and the plurality of bars rotatable relative to the center axis in response to rotation of the second rotating collar and the first rotating collar to fracture the tubular body, thereby i) opening a window in the plurality of bars, ii) shifting the plurality of bars to form a ramp oriented toward the window, and iii) locking the first and second rotating collars relative to the whipstock assembly holding the plurality of bars in position to form the ramp; and a plurality of external anchors configured to couple the whipstock assembly to an inner surface of a wellbore in which the whipstock assembly is disposed and prevent rotation of the whipstock assembly, at least one external anchor of the plurality of external anchors coupled between the circulation sub-assembly and the casing sub-assembly and at least one external anchor of the plurality of external anchors positioned between the casing sub-assembly and a downhole end of the whipstock assembly to prevent rotation of the circulation sub-assembly and the casing sub-assembly during shifting of the plurality of bars and locking of the first and second rotating collars by the drill bit.

2. The whipstock assembly of claim 1, wherein the ramp is angled to:

receive the drilling bottom hole assembly; and alter a direction of travel of the drilling bottom hole assembly toward the window.

3. The whipstock assembly of claim 1, further comprising a pin coupled the first rotating collar and the second rotating collar, the pin maintaining the first rotating collar and the second rotating collar in a locked position, wherein responsive to the pin shearing, allowing the first rotating collar and the second rotating collar to rotate to an unlocked position, rotating the plurality of bars, forming the ramp, and opening the window in the plurality of bars.

4. The whipstock assembly of claim 3, wherein the fracturable receptacle is coupled to the pin to transfer the weight from the drilling bottom hole assembly to the pin.

5. The whipstock assembly of claim 1, wherein the tubular body comprises a material drillable by a polycrystalline diamond compact drill bit.

6. The whipstock assembly of claim 1, further comprising:

a first hydraulic packer positioned at a first end of the whipstock assembly; and a second hydraulic packer positioned at a second end of the whipstock assembly, the second end opposite the first end.

7. The whipstock assembly of claim 1, the circulation sub-assembly comprising:

a cylindrical body defining an internal void;

one or more ports extending from the internal void through the cylindrical body to the space exterior the cylindrical body;

a sleeve positioned about the cylindrical body, the sleeve configured to control fluid flow through the one or more ports; and an actuator coupled to the sleeve, the actuator configured to operate the sleeve between an open position and a closed position.

8. The whipstock assembly of claim 1, wherein the plurality of guides comprises a series of voids extending through the tubular body.

9. The whipstock assembly of claim 1, wherein the plurality of guides comprises channels on an inner surface of the tubular body.

10. The whipstock assembly of claim 1, wherein the plurality of guides is configured to receive and pass the plurality of bars from the first rotating collar to the second rotating collar.

11. A method of sidetracking an open hole wellbore in a subterranean formation comprising:

disposing a whipstock assembly comprising a casing sub-assembly coupled to a drilling bottom hole assembly comprising a drill bit in the open hole wellbore, the casing sub-assembly comprising:

a fracturable receptacle;

a first rotating collar coupled to the fracturable receptacle downhole from the fracturable receptacle, the first rotating collar initially locked from rotation relative to the whipstock assembly and configured to rotate responsive to rotation of the fracturable receptacle by the drill bit;

a second rotating collar spaced apart from and downhole from the first rotating collar, the second rotating collar rotatable relative to the first rotating collar, the second rotating collar initially locked from rotation relative to the whipstock assembly, the second rotating collar configured to rotate responsive to rotation of the drill bit;

a tubular body positioned between the first rotating collar and the second rotating collar and defining a plurality of guides extending between the first rotating collar and the second rotating collar, the tubular body fracturable by both a transfer of a weight above a slack-off weight threshold weight from the drill bit through the fracturable receptacle and rotation of the first rotating collar and the second rotating collar; and a plurality of bars movable to a position aligned with a center axis of the whipstock assembly and extending between the first rotating collar and the second rotating collar in response to application of the weight above the slack-off weight threshold weight by the drilling bottom hole assembly and the drill bit, the plurality of bars held above the second rotating collar by the fracturable receptacle, and the plurality of bars rotatable relative to the center axis in response to rotation of the second rotating collar and the first rotating collar to fracture the tubular body, thereby i) opening a window in the plurality of bars, ii) shifting the plurality of bars to form a ramp oriented toward the window, and iii) locking the first and second rotating collars relative to the whipstock assembly holding the plurality of bars in position to form the ramp;

positioning the whipstock assembly in the open hole wellbore at a side-track location in the open hole wellbore;

shifting the plurality of bars into position extending between the first and second rotating collar using the drilling bottom hole assembly and the drill bit;

rotating the first rotating collar relative to the second rotating collar using the drilling bottom hole assembly and the drill bit;

responsive to rotating the first rotating collar relative to the second rotating collar, shifting the plurality of bars;

thereby forming the window in the whipstock assembly and forming the plurality of bars into the ramp angled toward the window;

guiding the drill bit along the ramp; and passing the drill bit out the window.

12. The method of claim 11, further comprising, before disposing the whipstock assembly coupled to the drilling bottom hole assembly in the open hole wellbore, coupling the drill bit to the whipstock assembly.

13. The method of claim 11, further comprising, before positioning the whipstock assembly coupled to the drilling bottom hole assembly in the open hole wellbore, receiving a shoe at a downhole end of the whipstock assembly.

14. The method of claim 11, wherein disposing the whipstock assembly coupled to the drilling bottom hole assembly in the open hole wellbore comprises:

receiving a ball at a ball seat of the whipstock assembly;

responsive to receiving the ball at the ball seat, closing a circulation path through the whipstock assembly;

responsive to closing the circulation path through the whipstock assembly, increasing a pressure equal to or greater than a threshold pressure; and responsive to increasing the pressure equal to or greater than the threshold pressure, setting a plurality of packers and extending and extending a plurality of anchors from the whipstock assembly to engage the subterranean formation.

15. The method of claim 11, wherein shifting the plurality of bars into position extending between the first and second rotating collar comprises:

receiving the slack-off weight threshold, shearing a pin; and responsive to shearing the pin, shifting the plurality of bars from a first position to a second position and fracturing the receptacle coupling the drill bit to the whipstock assembly.

16. The method of claim 15, further comprising, drilling the fracturable receptacle with the drill bit.

17. The method of claim 11, further comprising responsive to shifting the plurality of bars from a first position to a second position, fracturing the tubular body extending between the first rotating collar and the second rotating collar.

18. The method of claim 11, wherein rotating the first and second rotating collars to the second position locks the plurality of bars forming the ramp and the window.

19. The method of claim 11, further comprising, after guiding the drill bit along the ramp and passing the drill bit out the window:

contacting the drill bit to an inner surface of the open hole wellbore;

drilling, by the drill bit, a portion of the subterranean formation; and responsive to drilling the portion of the subterranean formation, sidetracking the open hole wellbore.

20. A method of completing a wellbore in a subterranean formation, the method comprising:

disposing a whipstock assembly coupled to a casing assembly in the wellbore, the whipstock assembly comprising:

a fracturable receptacle;

a first rotating collar coupled to the fracturable receptacle downhole from the fracturable receptacle, the first rotating collar initially locked from rotation relative to the whipstock assembly and configured to rotate responsive to rotation of a drill bit;

a second rotating collar spaced apart from and downhole from the first rotating collar, the second rotating collar rotatable relative to the first rotating collar, the second rotating collar initially locked from rotation relative to the whipstock assembly, the second rotating collar configured to rotate responsive to rotation of the drill bit;

a tubular body positioned between the first rotating collar and the second rotating collar and defining a plurality of guides extending between the first rotating collar and the second rotating collar, the tubular body fracturable by both a transfer of a weight above a slack-off weight threshold weight from the drill bit through the receptacle and rotation of the first rotating collar and the second rotating collar; and a plurality of bars movable to a position aligned with a center axis of the whipstock assembly and extending between the first rotating collar and the second rotating collar in response to application of the weight above the slack-off weight threshold weight by a directional bottom hole assembly and the drill bit, and the plurality of bars rotatable relative to the center axis in response to rotation of the second rotating collar and the first rotating collar to fracture the tubular body, thereby i) opening a window in the plurality of bars and the tubular body and ii) shifting the plurality of bars to form a ramp oriented toward the window;

running the directional bottom hole assembly coupled to the drill bit into the wellbore to contact the drill bit to the fracturable receptacle of the whipstock assembly with the drill bit, thereby shifting, by the drill bit, the plurality of bars into position extending between the first and second rotating collars;

rotating, by the drill bit, the first rotating collar relative to the second rotating collar, thereby shifting the plurality of bars forming the window and the ramp angled toward the window, the ramp angled to guide the drill bit out the window;

guiding the drill bit along the ramp; and passing the drill bit out the window.

* * * * *